US008914934B2

(12) United States Patent
Lee

(10) Patent No.: US 8,914,934 B2
(45) Date of Patent: Dec. 23, 2014

(54) USB CONNECTOR CLEANER

(71) Applicant: Hon Hai Precision Industry Co., Ltd., New Taipei (TW)

(72) Inventor: Bing-Heng Lee, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/972,857

(22) Filed: Aug. 21, 2013

(65) Prior Publication Data

US 2014/0208528 A1 Jul. 31, 2014

(30) Foreign Application Priority Data

Jan. 28, 2013 (TW) ..... 102103050 A

(51) Int. Cl.
*A46B 13/02* (2006.01)
*H01R 43/00* (2006.01)
*H01R 24/62* (2011.01)

(52) U.S. Cl.
CPC ..... *H01R 43/002* (2013.01); *H01R 24/62* (2013.01)
USPC ..... 15/97.1; 15/21.1; 15/22.2; 15/25; 385/53; 385/134

(58) Field of Classification Search
USPC ..... 15/97.1, 21.1, 22.2; 385/53, 134, 147
See application file for complete search history.

(56) References Cited

U.S. PATENT DOCUMENTS

| | | | | | |
|---|---|---|---|---|---|
| 74,743 | A * | 2/1868 | Bayston | 15/25 |
| 445,083 | A * | 1/1891 | Roy | 15/26 |
| 447,173 | A * | 2/1891 | Wendel | 15/73 |
| 2,887,702 | A * | 5/1959 | Freitag | 15/23 |
| 3,116,811 | A * | 1/1964 | Stevenson | 184/17 |
| 3,621,505 | A * | 11/1971 | Vocker et al. | 15/23 |
| 3,903,561 | A * | 9/1975 | McCaslin | 15/88 |
| 5,768,738 | A * | 6/1998 | Lee | 15/210.1 |
| 5,878,458 | A * | 3/1999 | Higginbotham | 15/104.94 |
| 6,209,162 | B1 * | 4/2001 | Clairadin et al. | 15/97.1 |
| 2009/0038090 | A1 * | 2/2009 | Beck et al. | 15/22.1 |
| 2012/0017384 | A1 * | 1/2012 | Fujiwara | 15/97.1 |

* cited by examiner

*Primary Examiner* — Monica Carter
*Assistant Examiner* — Michael Jennings
(74) *Attorney, Agent, or Firm* — Novak Druce Connolly Bove + Quigg LLP

(57) ABSTRACT

A USB connector cleaner for cleaning conductive pins received in a recess of a USB connector is provided. The USB connector cleaner includes a base, a cleaning head, and a driving member. The cleaning head is configured for inserting into the recess to clean the conductive pins. The cleaning head includes a supporting member fixed on the base and a cleaning brush rotatably connected to the supporting member. The driving member is slidably connected to the base for driving the cleaning brush to cleaning the conductive pins.

9 Claims, 3 Drawing Sheets

USB CONNECTOR CLEANER

BACKGROUND

1. Technical Field

The present disclosure relates to cleaning devices and, particularly, to a cleaner for cleaning a universal serial bus (USB) connector.

2. Description of Related Art

USB connectors have a recess for engagement with another USB connector. Contaminants may accumulate in the recess and degrade the performance of the USB connector. Because the recess is usually too small, manual cleaning can be inefficient.

What is needed therefore is a cleaner for cleaning USB connector addressing the limitations described.

BRIEF DESCRIPTION OF THE DRAWINGS

The components of the drawings are not necessarily drawn to scale, the emphasis instead being placed upon clearly illustrating the principles of the embodiments of the present disclosure. Moreover, in the drawings, like reference numerals designate corresponding parts throughout several views.

DETAILED DESCRIPTION

Figure 1:
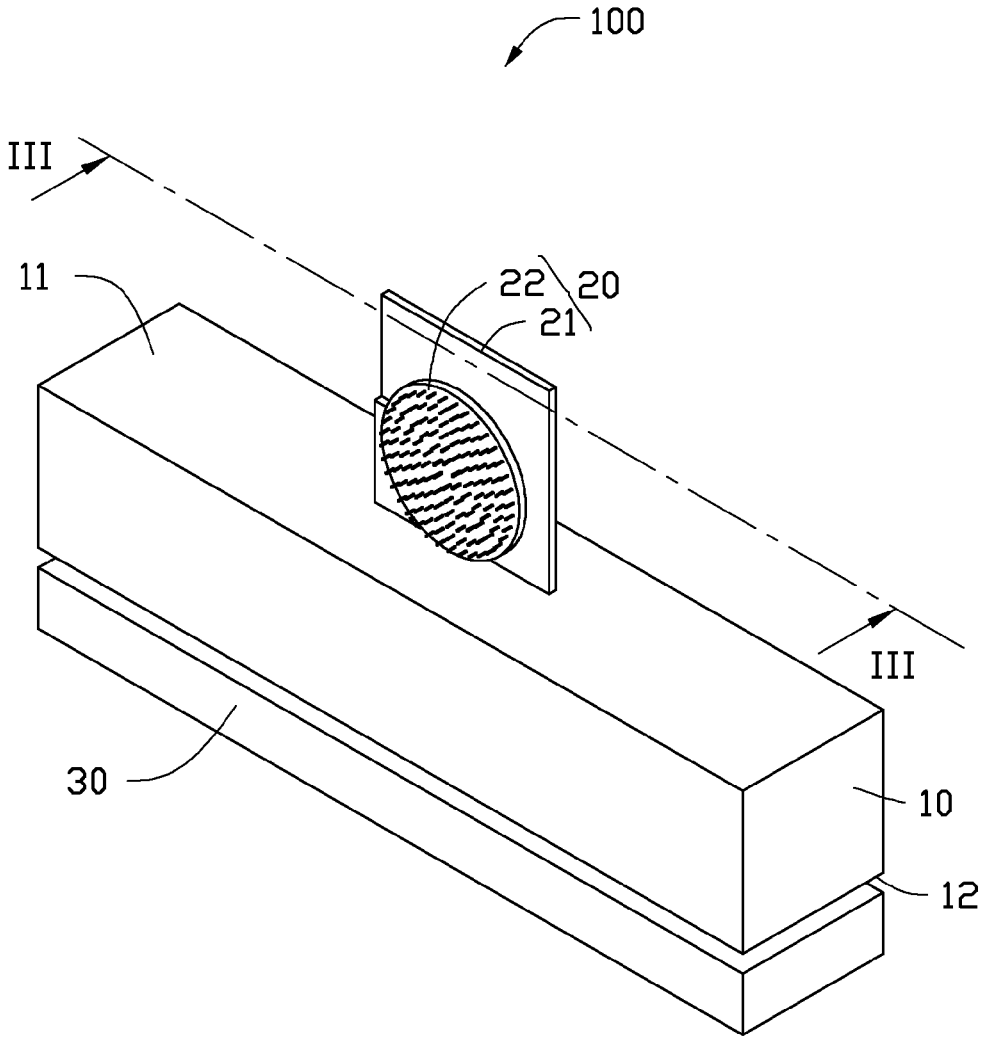
FIG. 1 is an isometric view of a USB connector cleaner, according to an exemplary embodiment of the present disclosure.
Figure 2:
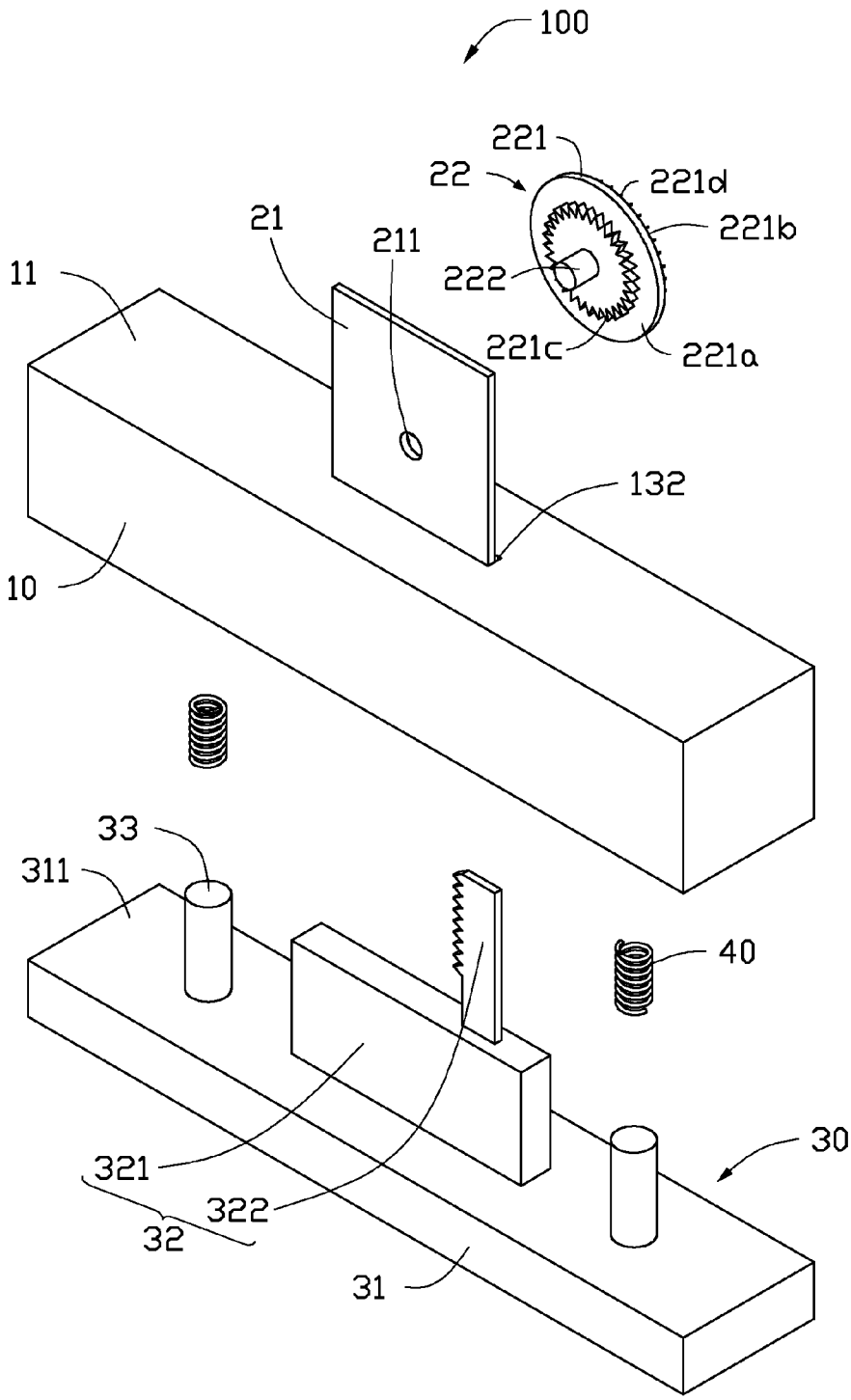
FIG. 2 is an exploded view of the USB connector cleaner of FIG. 1.
Figure 3:
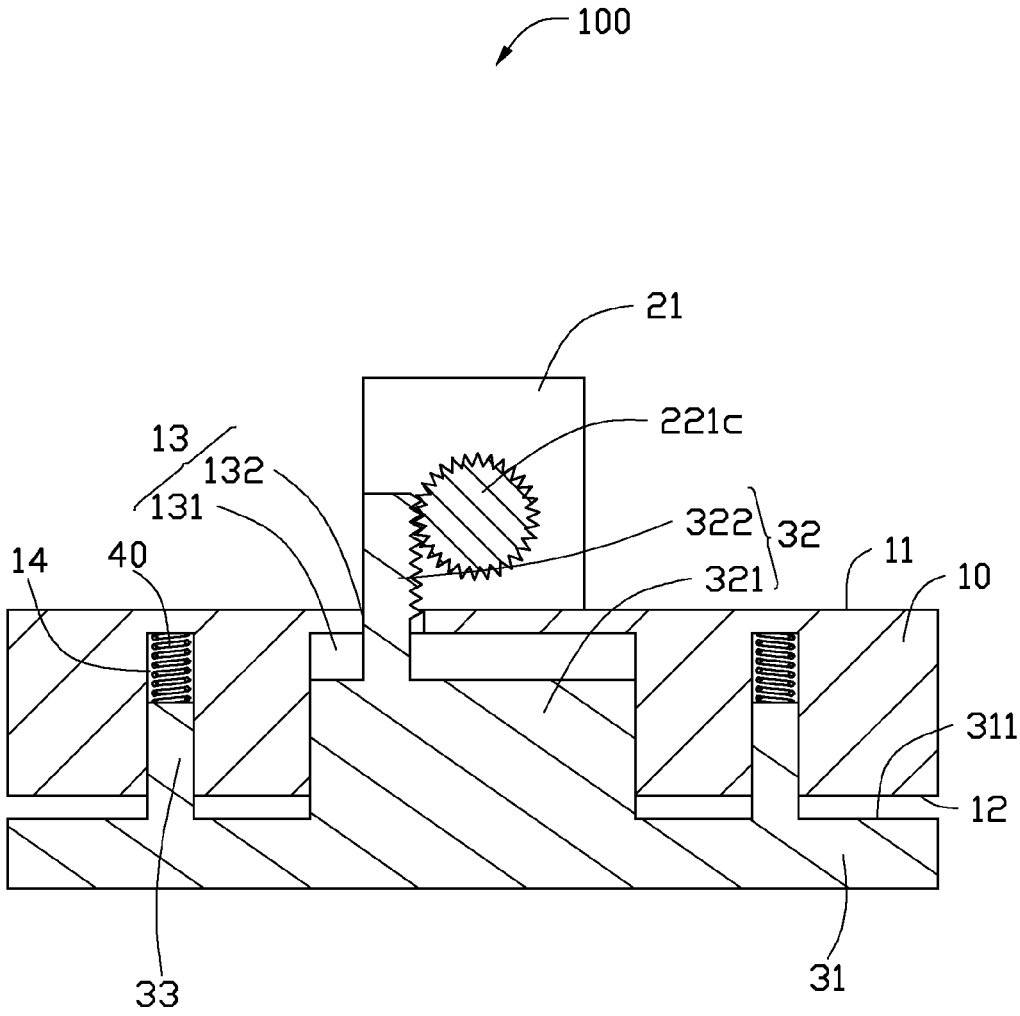
FIG. 3 is a sectional view of the USB connector cleaner of FIG. 1, taken along line III-III.

FIGS. 1-3 show a USB connector cleaner 100 according to an exemplary embodiment. The cleaner 100 includes a base 10, a cleaning head 20 connected to the base 10, and a driving member 30 slidably connected to the base 10.

The base 10 is substantially rectangular. The base 10 includes a first surface 11 and a second surface 12 opposite to the first surface 11. The cleaning head 20 is fixed on the first surface 11. The base 10 defines a through hole 13 passing through the first and second surfaces 11, 12. The through hole 13 is divided into a first hole portion 131 adjacent to the second surface 12 and a second hole portion 132 adjacent to the first surface 11. A size of the second hole portion 132 is smaller than that of the first hole portion 131. The base 10 further defines two guiding holes 14 in the second surface 12. The guiding holes 14 are positioned at two opposite sides of the through hole 13, respectively. In this embodiment, the guiding holes 14 are blind holes.

The cleaning head 20 includes a supporting member 21 and a cleaning brush 22 rotatably supported on the supporting member 21. The supporting member 21 defines a shaft hole 211. The cleaning brush 22 includes a disk body 221 and a shaft 222 connected to the disk body 221. The disk body 221 includes a first side surface 221*a* and a second side surface 221*b* opposite to the first side surface 221*a*. The disk body 221 includes a gear portion 221*c* formed on the first side surface 221*a* and a number of hairs 221*d* formed on the second side surface 221*b*. The shaft 222 is fixedly connected to a surface of the gear portion 221*c* away from the disk body 221 and coaxial with the gear portion 221*c*. The shaft 222 rotatably inserts into the shaft hole 211.

In other embodiments, the shaft hole 211 may be defined in the cleaning brush 22, and the shaft 222 may be formed on the supporting member 21.

A size of the cleaning head 20 should be small enough to insert into a recess of a USB connector (not shown).

The driving member 30 includes a handle portion 31, a driving portion 32 connected to the handle portion 31, and two guiding posts 33 connected to the handle portion 31 and corresponding to the guiding holes 14. The handle portion 32 includes a connecting surface 311 facing toward the second surface 12 of the base 10, the driving portion 32 and the guiding posts 33 are securely connected to the connecting surface 311. In this embodiment, the handle portion 32 is substantially rectangular-shaped. The driving portion 32 includes a sliding block 321 connected to the handle portion 32 and a rack 322 connected to an end of the sliding block 321 away from the handle portion 32. The handle portion 32 is slidably inserted into the through hole 13, the sliding bock 321 is received in the first hole portion 131, and the rack 322 passes out of the base 10 from the second hole portion 132 and meshes with the gear portion 221*c*. The guiding posts 33 are slidably inserted into the guiding holes 14, respectively.

The cleaner 100 further includes two restoring members 40 corresponding to the guiding posts 33. The restoring members 40 are respectively received in the guiding holes 14 and can be elastically compressed by the guiding posts 33. In this embodiment, the restoring members 40 are spiral springs.

In use, the cleaning head 20 is inserted into a recess of a USB connector (not shown). The second side surface 221*b* faces toward conductive pins of the USB connector, and the hairs 221*d* of the cleaning contacts with the conductive pins. The handle portion 31 of the driving member 30 is pressed to move to the base 10, the sliding block 321 moves to the cleaning head 20 along the first hole portion 131, and the rack 322 moves along a linear direction driven by the sliding block 321. During the movement of the rack 322, the cleaning brush 22 rotates to surround a central axis of the shaft 222. While the driving member 30 is moving toward the cleaning head 20, the guiding posts 33 elastically compress the restoring members 40. The handle portion 31 is driven to an original position by the restoring members 40, when a pressing force on the handle portion 31 stops. The cleaning brush 22 can also be rotated to clean the conductive pins 20 by a reverse movement of the rack 322.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the disclosure.

What is claimed is:

1. A USB connector cleaner for cleaning conductive pins received in a recess of a USB connector, the USB connector cleaner comprising:

a base;

a cleaning head connected to the base for inserting into the recess to clean the conductive pins, the cleaning head comprising:

a supporting member positioned on the base; and a cleaning brush rotatably connected to the supporting member; and a driving member slidably connected to the base for driving the cleaning brush to cleaning the conductive pins, the driving member comprising a handle portion and a driving portion connected to the handle portion, the driving portion comprising a sliding block and a rack, the sliding block being connected to the handle portion, and the rack being connected to an end of the sliding block away from the handle portion.

2. The USB connector cleaner of claim 1, wherein the cleaning brush comprises a disk body and a shaft connected to the disk body, the supporting member defines a shaft hole, the shaft rotatably inserts into the shaft hole.

3. The USB connector cleaner of claim 2, wherein the disk body comprises a gear portion formed on a side surface thereof, the shaft is fixed on a surface of the gear portion away from the side surface of the disk body and coaxial with the gear portion, and the gear portion is meshed with the driving member.

4. The USB connector cleaner of claim 3, wherein the disk body comprises a plurality of hairs formed on another side surface of the disk body opposite to the side surface with the gear portion.

5. The USB connector cleaner of claim 3, wherein the base defines through hole, the driving portion passes through the through hole and is connected to the disk body.

6. The USB connector cleaner of claim 5, wherein the through hole comprises a first hole portion and a second hole portion communicated with the first hole portion, the sliding bock is received in the first hole portion, and the rack passes out of the base from the second hole portion and meshes with the gear portion.

7. The USB connector cleaner of claim 5, wherein the driving member comprises two guiding posts formed on two opposite sides of the driving portion, the base defines two guiding holes corresponding to the guiding posts, and the guiding posts slidably insert into the guiding holes, respectively.

8. The USB connector cleaner of claim 7, wherein the USB connector cleaner comprises two restoring members corresponding to the guiding posts, the restoring members are respectively received in the guiding holes and elastically connected to the guiding posts.

9. The USB connector cleaner of claim 8, wherein the restoring members are spiral springs.

* * * * *